US005129917A

United States Patent [19]

Baillargeon et al.

[11] Patent Number: 5,129,917

[45] Date of Patent: Jul. 14, 1992

[54] POLY(AMINOALCOHOL) ADDITIVES TO IMPROVE THE LOW-TEMPERATURE PROPERTIES OF DISTILLATE FUELS AND COMPOSITIONS CONTAINING SAME

[75] Inventors: David J. Baillargeon, Cherry Hill; Angeline B. Cardis, Florence; Susan W. Johnson, Marmora, all of N.J.

[73] Assignee: Mobil Oil Corporation, Fairfax, Va.

[21] Appl. No.: 620,799

[22] Filed: Dec. 3, 1990

[51] Int. Cl.[5] ..... C07C 213/00; C10L 1/2

[52] U.S. Cl. ..... 44/425; 564/475; 564/477

[58] Field of Search ..... 564/475, 477; 44/425

[56] References Cited

U.S. PATENT DOCUMENTS

| | | | |
|---|---|---|---|
| 3,527,804 | 10/1970 | Cyba et al. | 44/425 |
| 3,891,709 | 6/1975 | Higuchi et al. | 564/475 |
| 3,944,397 | 3/1976 | Gardiner et al. | 44/425 |
| 4,259,086 | 3/1981 | Machleder et al. | 44/425 |
| 4,281,199 | 7/1981 | Langdon | 564/475 |
| 4,526,587 | 7/1985 | Campbell | 44/425 |
| 4,967,005 | 10/1990 | Smith | 564/475 |
| 4,992,590 | 2/1991 | Curida et al. | 564/475 |

FOREIGN PATENT DOCUMENTS

| | | | |
|---|---|---|---|
| 1096381 | 2/1981 | Canada | 44/425 |

*Primary Examiner*—Brian E. Hearn
*Assistant Examiner*—M. Muzzolillo
*Attorney, Agent, or Firm*—Alexander J. McKillop; Charles J. Speciale; Howard M. Fluornoy

[57] ABSTRACT

The reaction product of certain epoxy resins and secondary amines improve the low-temperature properties of distillate fuels.

13 Claims, No Drawings

POLY(AMINOALCOHOL) ADDITIVES TO IMPROVE THE LOW-TEMPERATURE PROPERTIES OF DISTILLATE FUELS AND COMPOSITIONS CONTAINING SAME

BACKGROUND OF THE INVENTION

This application is directed to poly(aminoalcohol) additives which are useful for improving the low-temperature properties of distillate fuels and fuel compositions containing same.

Traditionally, the low-temperature properties of distillate fuels have been improved by the addition of kerosene, sometimes in very large amounts (5–70 wt %). The kerosene dilutes the wax in the fuel, i.e. lowers the overall weight fraction of wax, and thereby lowers the cloud point, filterability temperature, and pour point simultaneously. The additives of this invention effectively lower both the cloud point and CFPP (Cold Filter Plugging Point) of distillate fuel without any appreciable dilution of the wax component of the fuel.

Other additives known in the art have been used in lieu of kerosene to improve the low-temperature properties of distillate fuels. Many such additives are polyolefin materials with pendent fatty hydrocarbon groups. These additives are limited in their range of activity, however; most improve fuel properties by lowering the pour point and/or filterability temperature. These same additives have little or no effect on the cloud point of the fuel. The additives of this invention effectively lower distillate fuel cloud point, and thus provide improved low-temperature fuel properties, and offer a unique and useful advantage over known distillate fuel additives. No art is known to applicants which teaches or suggests the additive products and compositions of this invention.

SUMMARY OF THE INVENTION

Novel poly(aminoalcohols) derived from epoxy resins such as novolac epoxy resins have been prepared and have been found to be surprisingly active wax crystal modifier additives for distillate fuels. Distillate fuel compositions containing <0.1 wt % of such additives demonstrate significantly improved low-temperature flow properties, i.e. lower cloud point and lower CFPP filterability temperature.

These additives are the reaction products of (1) a phenol-based or cresol-based epoxy resin, and (2) a secondary amine, such as di(hydrogenated tallow) amine. The poly(aminoalcohols) of this invention may also encompass compositions where a combination of two or more epoxy resins and/or two or more amines are used.

The primary object of this invention is to improve the low-temperature flow properties of distillate fuels. These new additives are especially effective in lowering the cloud point of distillate fuels, and thus improve the low-temperature flow properties of such fuels without the use of any light hydrocarbon diluent, such as kerosene. In addition, the filterability properties are improved as demonstrated by lower CFPP temperatures. Thus, the additives of this invention demonstrate multifunctional activity in distillate fuels.

The compositions of these additives are unique. Also, the additive concentrates and fuel compositions containing such additives are unique. Similarly, the processes for making these additives, additive concentrates, and fuel compositions are unique.

DESCRIPTION OF PREFERRED EMBODIMENTS

The additives of this invention are the reaction products of an epoxy resin, preferably a novolac epoxy resin, and a secondary amine, according to the following reaction:

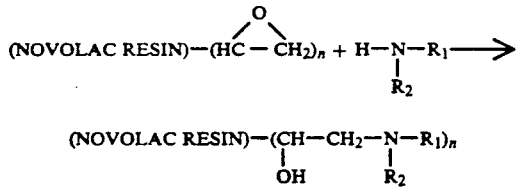

where $R_l$ equals $C_8$ to about $C_{50}$ linear hydrocarbyl groups, either saturated or unsaturated, and $R_2$ equals $R_1$, or $C_1$ to about $C_{100}$ hydrocarbyl, and $n \geqq 2$.

Suitable novolac resins may include phenol-based as well as cresol-based materials. Novolac resins are the oligomeric/polymeric products derived from the condensation of a phenolic chemical and formaldehyde, which have subsequently been reacted with epichlorohydrin (3-chloro-1,2-epoxypropane) to convert the phenol groups into glycidyl ethers. The degree of polymerization of the initial phenolic/formaldehyde is generally two or more, and thus the resins contain two or more reactive epoxide functional groups. The glycidyl ethers may also be derived from formaldehyde and a cresolic chemical.

Suitable amines, as indicated above, are secondary amines with at least one long-chain hydrocarbyl group. In this invention, stoichiometries of amine to epoxy resin were chosen such that one amine reacted with each available epoxide functional group of the epoxy resin. Other stoichiometries where the amine is used in lower molar proportions may also be used. Highly useful secondary amines include but are not limited to di(hydrogenated tallow) amine, ditallow amine, dioctadecylamine, methyloctadecylamine and the like.

The reactions can be carried out under widely varying conditions which are not believed to be critical. The reaction temperatures can vary from about 100° to 225° C., preferably 120° to 180° C., under ambient or autogenous pressure. However slightly higher pressures may be used if desired. The temperatures chosen will depend upon for the most part on the particular reactants and on whether or not a solvent is used. Solvents used will typically be hydrocarbon solvents such as xylene, but any non-polar, unreactive solvent can be used including benzene and toluene and/or mixtures thereof.

Molar ratios, less than molar ratios or more than molar ratios of the reactants can be used. Preferentially a molar ratio of 1:1 to about 10:1 of epoxide to amine is chosen.

The times for the reactions are also not believed to be critical. The process is generally carried out in from about one to twenty-four hours or more.

In general, the reaction products of the present invention may be employed in any amount effective for imparting the desired degree of activity to improve the low temperature characteristics of distillate fuels. In many applications the products are effectively employed in amounts from about 0.001% to about 10% by weight and preferably from less than 0.01% to about 5% of the total weight of the composition.

These additives may be used in conjunction with other known low-temperature fuel additives (dispersants, etc.) being used for their intended purpose.

The fuels contemplated are liquid hydrocarbon combustion fuels, including the distillate fuels and fuel oils. Accordingly, the fuel oils that may be improved in accordance with the present invention are hydrocarbon fractions having an initial boiling point of at least about 250° F. and an end-boiling point no higher than about 750° F. and boiling substantially continuously throughout their distillation range. Such fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate fuel oils, or mixtures of straight run distillate fuel oils, naphthas and the like, with cracked distillate stocks. Moreover, such fuel oils can be treated in accordance with well-known commercial methods, such as, acid or caustic treatment, hydrogenation, solvent refining, clay treatment, etc.

The distillate fuel oils are characterized by their relatively low viscosities, pour points, and the like. The principal property which characterizes the contemplated hydrocarbons, however, is the distillation range. As mentioned hereinbefore, this range will lie between about 250° F. and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuel oils are Nos. 1, 2 and 3 fuel oils used in heating and as diesel fuel oils, and the jet combustion fuels. The domestic fuel oils generally conform to the specification set forth in A.S.T.M. Specifications D396-48T. Specifications for diesel fuels are defined in A.S.T.M. Specification D975-48T. Typical jet fuels ar defined in Military Specification MIL-F-5624B.

The following examples are illustrative only and are not intended to limit the scope of the invention.

Wax crystal modifier additives prepared according to this invention are listed in Table 1. Effective wax crystal modifier additives may be prepared from phenol-based novolac resins (Entries 1-2), with the better additive performance shown by that resin with the higher degree of polymerization (Entry 2). Similarly, wax crystal modifier additives may be prepared from cresol-based novolac resins (Entries 3-4), with the better additive performance shown by that resin with the higher degree of polymerization (Entry 3).

A typical synthesis of these poly(aminoalcohols) is illustrated by the preparation of the cresol-based product of Entry 3 in Example 1.

EXAMPLE 1

Preparation of Additive Entry 3

Di(hydrogenated tallow) amine (65.0 g, 0.13 mol; e.g. Armeen 2HT from Akzo Chemie), and the novolac resin Araldite ECN-1299 (30.6 g, 0.024 mol; e.g. from Ciba-Geigy) were combined and heated at 140° C. for 24 hours. The reaction mixture was then hot filtered through Celite to give 84.43 g of the final product.

Preparation of Additive Concentrate

A concentrate solution of 100 ml total volume was prepared by dissolving 10 g of additive in an inert hydrocarbon solvent such as toluene or mixed xylenes solvent. Any insoluble particulates in the additive concentrate were removed by filtration before use. Generally speaking, each 100 ml portion of the concentrate solution may contain from 1 to about 50 g of the additive product of reaction.

| Test Fuel | |
|---|---|
| API Gravity | 34.1 |
| Cloud Point (°F.) | 23.4 |
| CFPP (°F.) | 16 |
| Pour Point (°F.) | 0 |
| Distillation (°F.; D 86) | |
| IBP | 319 |
| 10% | 414 |
| 50% | 514 |
| 90% | 628 |
| FBP | 689 |

Test Procedures

The cloud point of the additized distillate fuel was determined using an automatic cloud point test based on the commercially available Herzog cloud point tester; test cooling rate is approximately 1° C./min. Results of this test protocol correlate well with ASTM D2500 methods. The test designation (below) is "HERZOG."

The low-temperature filterability was determined using the Cold Filter Plugging Point (CFPP) test. This test procedure is described in "Journal of the Institute of Petroleum," Volume 52, Number 510, June 1966, pp. 173-185.

Test results may be found in Table 1 below.

TABLE 1

Additive Effect on the Cloud Point Out the Filterability of Distillate Fuel (Fuel A; 1000 ppm Additive)

| Entry | Amine | Epoxide | Mole Ratio | Performance Improvement Cloud Point (HERZOG) | (F):CFPP |
|---|---|---|---|---|---|
| 1 | Armeen 2HT | Araldite EPN-1139 | 2.2/1 | 1.8 | 5 |
| 2 | Armeen 2HT | Araldite EPN-1138 | 3.6/1 | 5.8 | 0 |
| 3 | Armeen 2HT | Araldite EPN-1299 | 5.4/1 | 6.3 | 5 |

TABLE 1-continued

| Additive Effect on the Cloud Point Out the Filterability of Distillate Fuel (Fuel A; 1000 ppm Additive) | | | | | |
|---|---|---|---|---|---|
| Entry | Amine | Epoxide | Mole Ratio | Performance Improvement Cloud Point (HERZOG) | (F):CFPP |
| 4 | Armeen 2HT | Araldite EPN-1235 | 2.7/1 | 2.3 | 5 |

Armeen 2HT: di(dihydrogenated tallow) amine
CFPP: cold filter plugging point
Araldite ECN-1235: glycidyl ether of formaldehyde/cresol adduct (degree of polymerization = 2.7)
Araldite ECN-1299: glycidyl ether of formaldehyde/cresol adduct (degree of polymerization = 5.4)
Araldite ECN-1138: glycidyl ether of formaldehyde/cresol adduct (degree of polymerization = 3.6)
Araldite ECN-1139: glycidyl ether of formaldehyde/cresol adduct (degree of polymerization = 2.2)

We claim:

1. A fuel composition comprising a major proportion of a liquid hydrocarbon fuel and a minor low temperature improving amount of the reaction product of an epoxy resin selected from the group consisting of novolac epoxy resins derived from phenol-based or cresol-based materials and a secondary amine having the following general structural formula:

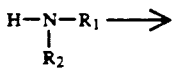

where $R_1 = C_8$ to about $C_{50}$ linear hydrocarbyl groups and $R_2 = R_1$ or $C_1$ to about $C_{100}$ hydrocarbyl, said reactants being reacted in substantially molar, less than molar or more than molar amounts at temperatures varying from about 85° to about 250° C. under ambient or autogenous pressures for a time sufficient to obtain the desired poly(aminoalcohol) additive product of reaction.

2. The fuel composition of claim 1 comprising from about 0.001% to about 10% by weight of the total composition of said additive reaction product.

3. The fuel composition of claim 1 wherein the epoxy resin contains glycidyl ethers as the reactive epoxide functional group.

4. The fuel composition of claim 1 wherein the epoxy resin is a novolac resin derived from phenol-based or cresol-based materials.

5. The fuel composition of claim 4 wherein the poly(aminoalcohol) is prepared in accordance with the following reaction:

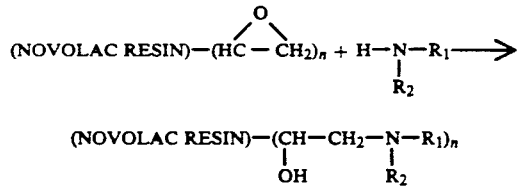

where $R_1$ equals $C_8$ to about $C_{50}$ linear hydrocarbyl groups, either saturated or unsaturated, and $R_2$ equals $R_1$, or $C_1$ to about $C_{100}$ hydrocarbyl, and $n \geqq 2$.

6. The fuel composition of claim 4 wherein said resin is selected from oligomeric/polymeric products derived from the condensation of a phenolic or cresolic compound and formaldehyde subsequently reacted with epichlorohydrin converting the phenol/cresol groups into glycidyl ethers.

7. The fuel composition of claim 4 wherein the amine is selected from the group consisting of ditallow amine, di(hydrogenated tallow) amine, dioctadecylamine, methyloctadecylamine or mixtures thereof.

8. The fuel composition of claim 7 wherein the amine is di(hydrogenated tallow) amine.

9. The fuel composition of claim 6 wherein the glycidyl ether is a formaldehyde/cresol adduct.

10. The fuel composition of claim 6 wherein the glycidyl ether is a formaldehyde/phenol adduct.

11. The composition of claim 1 wherein the fuel is a liquid hydrocarbon combustion fuel selected from the group consisting of distillate fuels and fuel oils.

12. The composition of claim 11 wherein the fuel oil is selected from fuel oil numbers 1, 2 and 3 diesel fuel oils and jet combustion fuels.

13. The composition of claim 12 wherein the fuel is a diesel fuel.

* * * * *